US005375834A

United States Patent [19]

Rathert

[11] Patent Number: 5,375,834

[45] Date of Patent: Dec. 27, 1994

[54] STACKING METHOD AND APPARATUS

[75] Inventor: Horst Rathert, Minden, Germany

[73] Assignee: Kolbus GmbH & Co. KG, Rahden, Germany

[21] Appl. No.: 151,559

[22] Filed: Nov. 12, 1993

[51] Int. Cl.[5] ..... B65H 29/54

[52] U.S. Cl. ..... 271/310; 271/82; 271/183; 271/211; 271/184; 271/84

[58] Field of Search ..... 271/82, 84, 182, 183, 271/184, 189, 204, 207, 211, 225, 306, 309, 310, 900, 276

[56] References Cited

U.S. PATENT DOCUMENTS 4,169,341 10/1979 Roetter et al. ..... 53/154
4,355,800 10/1982 Sugiyama ..... 271/276 X

FOREIGN PATENT DOCUMENTS

3935372A1 4/1991 Germany .
58-109360 9/1983 Japan .

OTHER PUBLICATIONS

Xerox Disclosure Journal, vol. 16, No. 6, Nov. 1991.

*Primary Examiner*—H. Grant Skaggs
*Assistant Examiner*—Carol L. Druzbick
*Attorney, Agent, or Firm*—Chilton, Alix & Van Kirk

[57] ABSTRACT

An apparatus for stacking cards, printed sheets or similar products has feeder stations situated in a row and a conveyor with pushers. The feeder stations include spaced inner and outer tables. Individual products are deposited on the tables at the feeder stations. The inner tables are provided with lateral stops and a plurality of nozzles which emerge from the upper surface at a shallow angle towards the stop. Compressed air emitted from these nozzles creates a suction force which stabilizes the products on the tables. The pushers extend between the tables and push the product through a cut-out in the outer table onto a stack of products moving in synchronization on the conveyor below the tables.

20 Claims, 2 Drawing Sheets

STACKING METHOD AND APPARATUS

BACKGROUND OF THE INVENTION

1. Field of the Invention

The present invention relates to a method and apparatus of stacking cards, printed sheets or similar products. More specifically, this invention is directed to apparatus having a plurality of product feeder stations situated in a row, a conveyor defining a channel and having pushers that propell the products along the channel as stacks are formed and receiver means located between the feeder stations and the channel for controlling the delivery of the products to the channel under the influence of the pushers.

2. Description of the Prior Art

While not limited thereto in its utility, the present invention is particularly well suited for use in the stacking of landscape-formal cards or printed sheets. It is common practice in the art to form such printing work products into stacks for temporary storage or transportation. The previously available stacking apparatus, as exemplified by the disclosure of published German patent application 39 35 372, have had a number of inherent deficiencies.

Previous apparatus were designed for stacking small-format cards or printed sheets. The pushers associated with the conveying chain are positioned close to a lateral stop. When broadside or landscape-format cards or printed sheets are pushed from the receiving table of such apparatus the products have a tendency to twist. This twisting can be counteracted by the use of guide rails. However, the product may become skewed on the guide rail.

Furthermore, the product may lift upwardly during transport as a result of air flowing under the leading edge. This action is especially prevalent when the product is bowed to a convex shape. Current apparatus utilize drag springs to correct this problem. However, these springs are only effective if the product is composed of stiff material.

SUMMARY OF THE INVENTION

The present invention overcomes the above-briefly discussed and other deficiencies and disadvantages of the prior art by providing a novel technique for the stacking of broadside or landscape-format cards, printed sheets or similar products. The present invention also encompasses apparatus for use in the practice of this novel method.

Stacking apparatus in accordance with the present invention includes a conveyor with pushers, a receiving table, and a pull-off drum. The products are acquired, in a manner known in the art, by a gripper mechanism mounted on the pull-off drum. The product is deposited by the gripper mechanism on the receiving table. The table is divided into two sections by the conveyor. The pushers associated with the conveyor reach above the table surface and sweep the product from the table to the conveyor so as to form a stack. An inner section of the receiving table is provided with a row of gas discharge ports which are directed at a shallow angle relative to the table surface. Compressed air blown through these ports creats a suction effect that pulls the product into close proximity to the table surface. This effect stabilizes the product during transfer from the table to the stack.

BRIEF DESCRIPTION OF THE DRAWING

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENT

Figure 1:
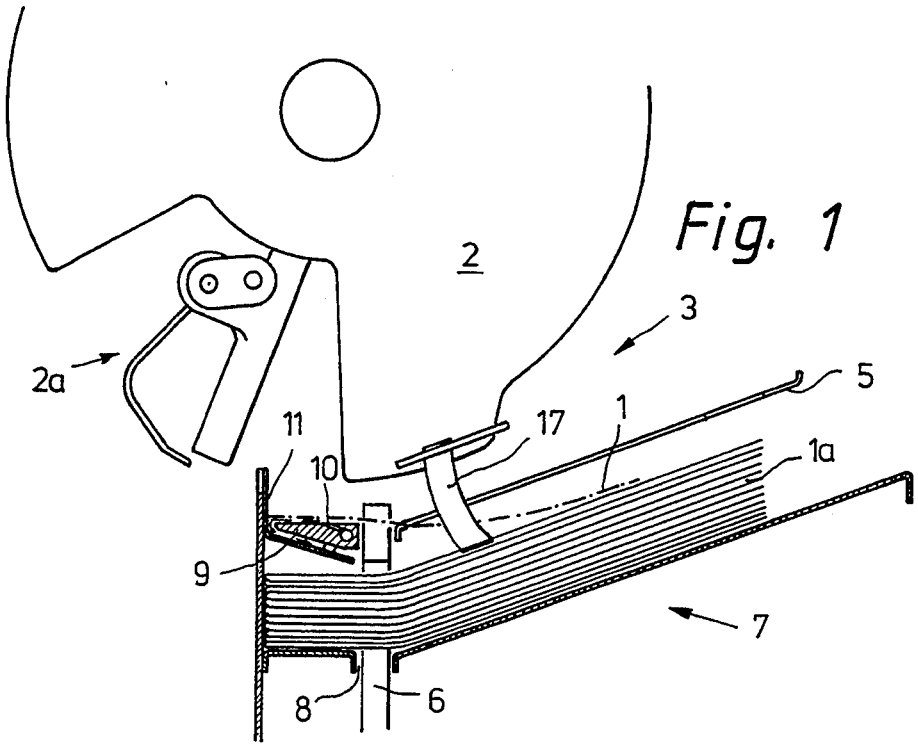
FIG. 1 is a schematic, front elevation view of apparatus in accordance with the present invention.
Figure 2:
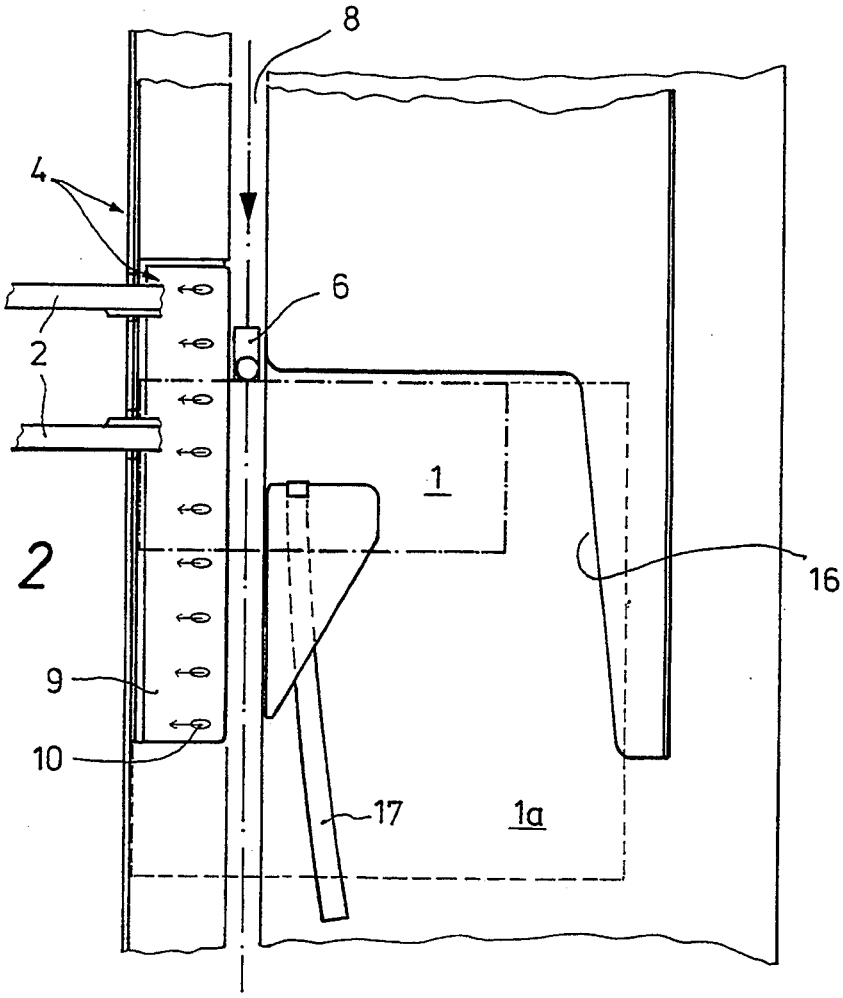
FIG. 2 is a top view, partly in phantom, of the apparatus of FIG. 1.
Figure 3:
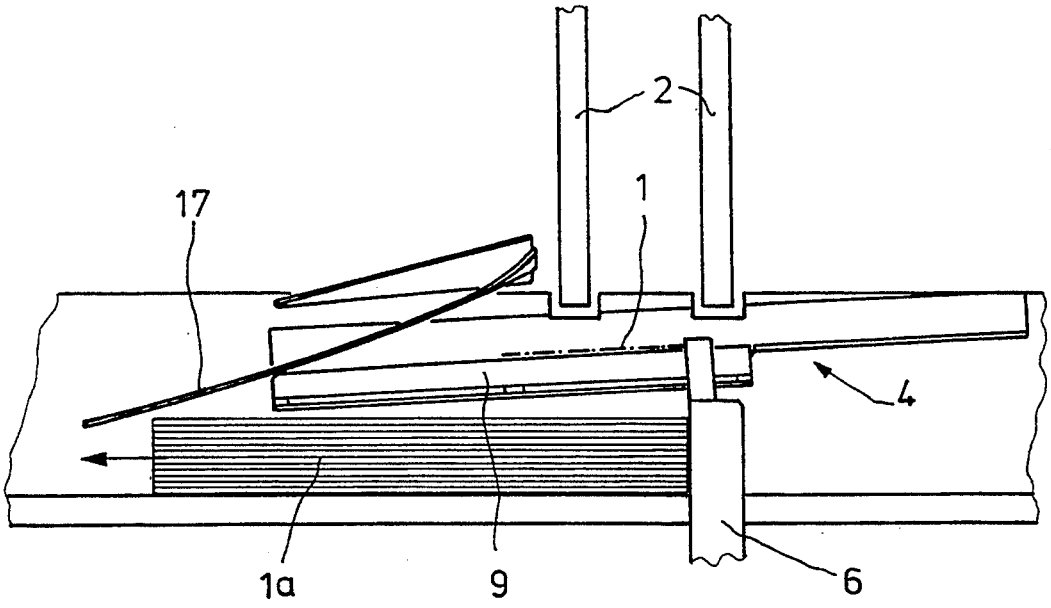
FIG. 3 is a side view of the apparatus of FIG. 1.

With reference to the drawings, a stacking apparatus in accordance with the present invention is generally designated by the numeral 3. The apparatus essentially consists of a conveyor defining a transport channel, indicated generally at 7, a receiving table 4, 5, and a pull-off drum 2. Drum 2 is located between the receiving table and a magazine (not shown). The thin, relatively large, sheet-like products 1 that are to be stacked are acquired, in a known manner, by means of a gripper mechanism 2*a* which is mounted on the pull-off drum 2. The gripper mechanism 2*a* deposits the products i on the receiving table 4, 5. Receiving table 4, 5 slopes in the transport direction and is divided into an inner receiving table 4 and an outer receiving table 5. Pushers 6, carried by a conveying chain of conveyor 7, extend through a longitudinal aperture 8 defined by sections 4 and 5 of the receiving table. Pushers 6 engage and sweep the product 1 from table 4, 5 and thus transfer it to the top of a stack moving along conveyor 7.

In order to achieve functionally reliable, i.e., controlled, movement of a product 1 which is of an extreme broadside or landscape format, the inner receiving table 4 is provided with a flush-located jet body 9 in a region beginning from approximately the middle of the pull-off drum 2 and extending as far as the end of the receiving table. The jet body 9 has a row of discharge ports 10 which extend in the transport direction. The ports 10 provide jets of gas which emerge from the surface of the jet body 9 at a shallow angle and a directed laterally towards a stop 11. A source of compressed air (not shown) is coupled to the nozzles associated with ports 10 via a plenum 18.

The jet body 9 is positioned with a defined clearance 12, relative to the lateral stop 11, and this enables the air flow to be discharged downwards via a flow passage 14 which is formed by the underside of the jet body 9 and a shroud 13.

At its end, the flow passage 14 blends into a diffuser 15 which prevents the creation of interfering airflows and reduces the flow velocity to an insignificant value.

Figure 4:
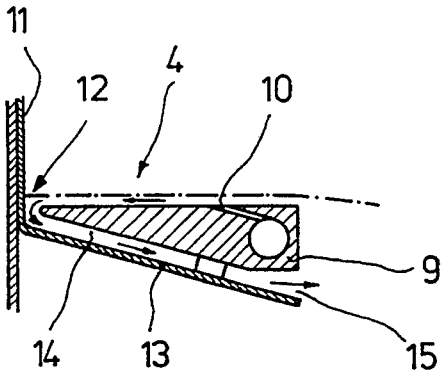
FIG. 4 is an enlarged view of Area A of FIG. 1.

The air flow through passage 14 creates a pressure differential which urges the product 1 down into close proximity to the surface of the jet body 9. At the same time, the air flow causes product 1 to be urged against the vertically oriented lateral stop 11. The air flow path is indicated by the arrows on FIG. 4.

The pushers 6, associated with the gathering conveyor 7, engage the product 1 from behind and push the product forwardly in the transport direction. During the resulting product motion, skewing moments are compensated by the stabilizing moment generated by the above defined force that urges the product against the lateral stop 11. The frictional force which occurs between the product side edge and the lateral stop 11 likewise exerts a stabilizing effect, and prevents the product 1 from jumping forwardly when contacted by the pushers. The above-described suction effect gives rise to a holding-down action, and prevents the product from flying upwards as a result of the relative airflow under the product due to its movement in the transport direction.

As soon as the product 1, over its entire length, has reached a cut-out 16 in the outer receiving table 5, the unsupported end of the product 1, assisted by the action of a drag spring 17, falls onto the stack la which is being moved forwards underneath table 4, 5 in a transport channel. During its descent, the product 1 is stabilized in its position as a result of its unsupported end bearing against the stack 1*a*.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In an apparatus for stacking cards, printed sheets or similar products, the apparatus having serially arranged plural feeder stations, the apparatus further having a conveyor which defines a transport channel extending along a transport path, the conveyor having pushers which move in a transport direction to cause products to move along said transport path, the apparatus also having inner and outer receiving tables, the tables having top surfaces for receiving products at the feeder stations, the improvement comprising:

the inner table having a lateral stop which extends longitudinally in said transport direction and a product support surface provided with a plurality of gas discharge ports, said ports being sized and shaped to discharge gas towards said lateral stop at a shallow angle relative to said support surface;

means for supplying a pressurized gas to said ports; and means for directing gas discharged through said ports downwardly and away from said lateral stop whereby a pressure differential will be created across a product supported on said inner table in contact with said stop.

2. The apparatus of claim 1 wherein said inner table comprises a jet body having upper and lower surfaces, said jet body upper surface being co-planar with said inner table support surface, said ports being located in said jet body upper surface.

3. The apparatus of claim 2 wherein said gas directing means comprise a shroud mounted in spaced relationship to said jet body lower surface to define a gas flow passage between said jet body and said lateral stop and between said shroud and said jet body.

4. The apparatus of claim 3 wherein said shroud comprise diffuser means wherein pressurized gas flowing through said directing means is diffused on exiting said directing means.

5. The apparatus of claim 4 wherein said outer table includes a cut-out, said cut-out opening in a direction towards of said jet body and in the transport direction.

6. The apparatus of claim 5 further comprising a drag spring installed proximate to said cut-out, said drag spring imposing a downward force on the product.

7. The apparatus of claim 2 wherein said outer table includes a cut-out, said cut-out opening in a direction towards said jet body and in the transport direction.

8. The apparatus of claim 7 further comprising a drag spring installed proximate to said cut-out, said drag spring imposing a downward force on the product.

9. Apparatus for stacking thin, flexible sheets of printed matter, the apparatus having a plurality of serially arranged feeder stations which are situated in a row and a conveyor including a transport channel, the conveyor also having pushers which move in a transport direction, said apparatus comprising:

inner and outer tables for receiving individual sheets the feeder stations, said tables being separated at a region which is in registration with the conveyor whereby the pushers may engage a product supported on said tables, said inner table having upper and lower surfaces and a lateral stop extending vertically above said upper surface, said inner table further having a plurality of bores emerging from said top surface, said bores having axes which are inclined at a shallow angle towards said lateral stop;

gas supply means in fluid communication with said bores; and discharge means wherein pressurized gas discharged from said bores is directed downwards and away from said lateral stop.

10. The apparatus of claim 9 wherein the inner table comprises a jet body which includes said table upper and lower surfaces, said upper surface being co-planar with a top surface of said outer table, said bores being located in said jet body, said jet body being spaced from said lateral stop.

11. The apparatus of claim 10 wherein said discharge means comprises a shroud mounted in spaced relationship to said jet body lower surface, said shroud cooperating with said jet body to define a flow passage which communicates with the space between said jet body and said lateral stop.

12. The apparatus of claim 11 wherein said discharge means further comprises diffuser means communicating with said flow passage whereby pressurized gas flowing through said discharge means is diffused on exiting said discharge means.

13. The apparatus of claim 11 wherein said outer table further comprises a cut-out, said cut-out being open in a direction towards of said jet body and in the transport direction.

14. The apparatus of claim 13 further comprising a drag spring installed proximate to said cut-out, said drag spring imposing a downward force on the sheets.

15. The apparatus of claim 10 wherein said outer table further comprise a cut-out, said cut-out being open in a direction towards of said jet body and in the transport direction.

16. The apparatus of claim 15 further comprising a drag spring installed proximate to said cut-out, said drag spring imposing a downward force on the sheets.

17. In a method of stacking thin, flexible indicia bearing sheets which are extracted singly from magazines, the improvement comprising:

depositing an extracted sheet on a receiving table comprising spaced inner and outer table sections positioned above a transport;

directing a flow of pressurized gas over a portion of the inner table upper surface and beneath said sheet to generate a pneumatic sheet hold-down force; and pushing said sheet in a transport direction whereby said sheet is pushed off the receiving table onto the transport to thereby deposit said sheet on top of at least another sheet previously deposited on the transport to form a stack of sheets moving on the transport.

18. The method of claim 17 further comprising:

urging said sheet in a direction transverse to the transport direction and against a lateral stop by means of pneumatic pressure.

19. The method of claim 18 wherein the step of pushing comprises:

mechanically forcing said sheet downwardly through a cut-out in the outer table.

20. The method of claim 19 wherein the step of pushing further comprises:

extending a pusher element from the transport through the space between the inner and outer table sections to engage said sheet.

* * * * *

UNITED STATES PATENT AND TRADEMARK OFFICE

CERTIFICATE OF CORRECTION

PATENT NO. : 5,375,834
DATED : December 27, 1994
INVENTOR(S) : Horst Rathert

It is certified that error appears in the above-indentified patent and that said Letters Patent is hereby corrected as shown below:

In column 2, line 27, "i" should be --1--.

In column 3, line 13, "la" should be --1a--.
line 65, delete "of".

In column 4, line 13, after "sheets", insert --at--;
line 49, delete "of";
line 56, delete "of".

Signed and Sealed this

Tenth Day of September, 1996

Bruce Lehman

*Attest:*

BRUCE LEHMAN

*Attesting Officer*

*Commissioner of Patents and Trademarks*